US006555961B1

(12) United States Patent
Brainard et al.

(10) Patent No.: US 6,555,961 B1
(45) Date of Patent: Apr. 29, 2003

(54) ANODE INITIATED SURFACE FLASHOVER SWITCH

(75) Inventors: John P. Brainard, Albuquerque, NM (US); Robert J. Koss, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 41 days.

(21) Appl. No.: 09/947,106

(22) Filed: Sep. 4, 2001

(51) Int. Cl.[7] ..... H01J 17/30
(52) U.S. Cl. ..... 313/602
(58) Field of Search ..... 313/589, 231.31, 313/602, 631

(56) References Cited

U.S. PATENT DOCUMENTS 5,475,055 A 12/1995 Deckers et al. ..... 313/54

OTHER PUBLICATIONS

Engel, Kristiansen, Baker and Hatfield; "Surface–discharge Switch Design: The Critical Factor" ; IEEE Transactions on Electron Devices, vol. 3, No. 4, Apr. 1991;pp. 740–744.

Feldman and Henaff; Bilinear Signal Processing; Appi. Phys. Lett., vol. 24, No. 2, Jan. 15, 1974; pp. 54–56.

Masten, Muller, Hegeler and Kompholz; "Plasma Development in the Early Phase of Vacuum Surface Flashover"; IEEE Transaction on Plasma Science, vol. 22, No. 6, Dec. 1994; pp. 1034–1042.

Brainard and Jensen; "Electron Avalanche and Surface Charging on Alumina Insulators During Pulsed High–Voltage Stress"; Journal of Applied Physics, vol. 45, No. 8. Aug. 1974; pp. 3260–3265.

Anderson and Brainard; "Mechanism of Pulsed Surface Flashover Involving Electron–Stimulated Desorption"; J. Appl. Phys. 51(3), Mar. 1980; pp. 1414–1421.

Koss and Brainard; "Partial Discharge in a High voltage Experimental Test Assembly"; SAND98–4987 Printed Jul. 1998; pp. 1–13.

Anderson; "Review of Surface Flashover Theory"; SAND89–127GC; 1–15.

*Primary Examiner*—Vip Patel
(74) *Attorney, Agent, or Firm*—George H Libman

(57) ABSTRACT

A high voltage surface flashover switch has a pair of electrodes spaced by an insulator. A high voltage is applied to an anode, which is smaller than the opposing, grounded, cathode. When a controllable source of electrons near the cathode is energized, the electrons are attracted to the anode where they reflect to the insulator and initiate anode to cathode breakdown.

24 Claims, 2 Drawing Sheets

ANODE INITIATED SURFACE FLASHOVER SWITCH

The United States Government has rights in this invention pursuant to Department of Energy Contract No. DE-AC04-94AL85000 with Sandia Corporation.

CROSS REFERENCE TO RELATED APPLICATIONS (Not Applicable)

BACKGROUND OF THE INVENTION

The spark gap device is a traditional solution to high voltage, high current, switching applications. U.S. Pat. No. 4,475,055 of G. Boettcher shows a spark gap device including a conducting anode and cathode separated by an insulator. The device is triggered by ionizing a gas between the anode and cathode, causing a conductive plasma to be generated between the electrodes.

The typical spark-gap device utilizes a pair of electrodes in a vacuum spaced from each other by an insulator. When a high voltage is placed across the electrodes, the electrically-stressed insulator may undergo surface-flashover at an applied field more than an order of magnitude below the bulk dielectric strength of the insulator.

J. Brainard et al, Electron avalanche and surface charging on alumina insulators during pulsed high-voltage stress, Journal of Applied Physics, Vol. 45, No. 8, August 1974, pp. 3260–3264, modeled insulator surface charging on high-voltage diodes. The object of this understanding was to prevent such discharges.

R. Anderson et al, Mechanism of pulsed surface flashover involving electron-stimulated desorption, Journal of Applied Physics, Vol. 51, No. 3, 1980, pp. 1414–1421, showed that surface flashover of dielectrics results from a gas that is desorbed from the insulator by impinging electrons resulting from a breakdown in vacuum.

The spark gap switch relies on electron transport through a gas. A surface breakdown switch is shown in U.S. Pat. No. 5,821,705 of G. Caporaso et al which provides faster switching by surface breakdown of the device.

There is not universal agreement as to what happens at each stage of a surface flashover. R. Anderson, Review of Surface Flashover Theory, Sandia National Laboratories report SAND89-1276C, July 1989 (available from NTIS, Springfield, Va. 22161), reviews some of the theories that had been proposed to explain each of cathode-initiated and anode-initiated surface flashover. The content of this report is incorporated herein by reference. Some additional theories are referenced below.

A. Neuber et al, Dielectric Surface Flashover in Vacuum at 100KV, IEEE Transactions on Dielectrics and Insulation, Vol. 6, No. 4, Aug. 1999, pp. 512–515, indicates that surface flashover in vacuum at room temperature "is usually started by field emission of electrons from the cathode, phase (1). A subsequent electron avalanche development is governed by secondary electron emission from the dielectric surface, followed by electron induced outgassing of adsorbed gas molecules, phase (2). A gas breakdown was found to form in the expanding gas layer above the surface, leading to the final discharge, phase (3)."

G. Masten et al, Plasma Development in the Early Phase of Vacuum Surface Flashover, IEEE Transactions on Plasma Science, Vol. 22, No. 6, Dec. 1994, pp. 1034–1042, used laser deflection from a test setup in vacuum and concluded that deflection measurements "imply that charge-carrier amplification within the developing discharge occurs above the surface of the insulator, in a region of neutral particles desorbed or otherwise ejected from the insulator surface."

T. Engle et al, Surface-Discharge Switch Design: The Critical Factor, IEEE Transactions on Electron Devices, Vol. 38, No. 4, April 1991, pp. 740–744, notes that "most designers [of high power, low impedance closing switches] prefer and use other types of switches (e.g. spark gaps, thyratrons, ignitrons, etc.). This is because the surface-discharge-switch (SDS) suffers from poor voltage holdoff recovery (caused by decomposition of the switching dielectric) and from dielectric 'punch-through' (caused by dielectric erosion). Thus the selection of the switching dielectric is the critical factor which must be considered by the designer if the SDS is to have a long and trouble-free lifetime."

Historically, the surface flashover (or discharge) switch has not been too successful because designs that favor the required electron avalanching usually have poor voltage hold-off capability. In other words, the desired switching voltage is approximately the same as the voltage that is across the switch while it is open circuited. A desired switch should have switching voltage significantly lower than the hold-off voltage, to prevent unintended discharge of the switch.

R. Koss et al, Partial Discharge in a High Voltage Experimental Test Assembly, Sandia National Laboratories report SAND98-1654, Sandia National Laboratories, July 1998, describes an observation by the inventors of an undesirable breakdown in a high voltage test assembly with an insulator between two electrodes that was designed not to break down. Protrusions on the insulator near the anode end of the device caused high fields that released electrons from the insulator that strike the anode with sufficient energy to vaporize and ionize the metal. The anode discharge is then sustained by secondary electrons from the insulator that propagate by field enhancement to the cathode, opposite the normal direction of discharge. A related breakdown is discussed in the aforementioned *Review of Surface Flashover Theory.*

SUMMARY OF THE INVENTION

It is an object of this invention to provide a high voltage, high current, surface flashover switch utilizing an insulator that is designed not to avalanche at the cathode.

To achieve the foregoing and other objects, and in accordance with the purpose of the present invention, as embodied and broadly described herein, a high voltage switch in accordance with the invention may include an electrically conductive cathode having inner and outer spaced surfaces; and an electrically conductive anode having inner and outer spaced surfaces, the inner surface of the anode facing the inner surface of the cathode. A hollow tubular insulator is sealed at one end to the inner surface of the anode and at an opposite end to the inner surface of the cathode, defining a volume which is evacuated. A controllable generator of electrons adjacent the cathode causes the switch to change from a non-conducting to a conducting state as a result of an anode initiated breakdown.

Additional objects, advantages, and novel features of the invention will become apparent to those skilled in the art upon examination of the following description or may be learned by practice of the invention. The objects and advantages of the invention may be realized and attained as particularly pointed out in the appended claims.

BRIEF DESCRIPTION OF THE DRAWINGS

The accompanying drawings, which are incorporated in and form part of the specification, illustrate an embodiment of the present invention and, together with the description, serve to explain the principles of the invention.

DETAILED DESCRIPTION OF THE INVENTION

Figure 1:
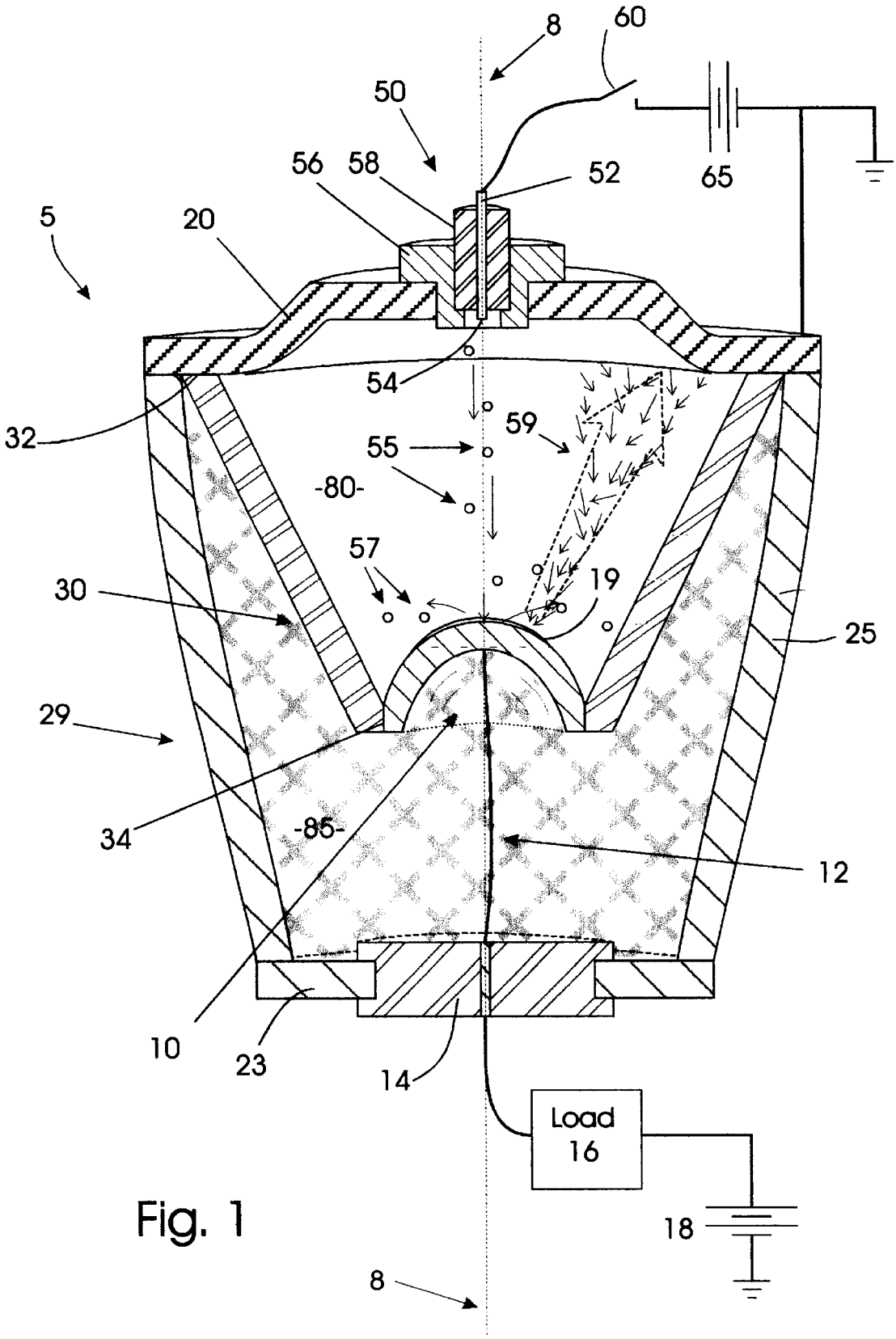
FIG. 1 shows an embodiment of a switch according to this invention.

A high vacuum switch 5 is shown in FIG. 1 to include an electrically conductive anode 10 spaced from an electrically conductive cathode 20 by a tubular insulator 30 that extends between these electrodes. Each end of insulator 30 is sealed to one of the electrodes, forming an enclosure 80 that is evacuated, as discussed hereinafter. All vacuum switches have these components, although there are many possible shapes and configurations for these components.

In a typical application, cathode 20 is grounded and high voltage 18 is applied through load 16 to anode 10 via conductor 12. Switch 5 may further include a metal case 29 that is grounded at one end to cathode 20 and which surrounds insulator 30 and anode 10. As shown, case 29 includes a tubular member 25 that is connected at one end to cathode 20 outside insulator 30, and at an opposite end to a base 23 that closes case 29. An insulating disk 14 in base 23 provides an electrical pass-through for conductor 12 which connects load 16 to anode 10. To reduce the possibility of undesirable arcing, a high-dielectric constant insulating material 85 fills the volume inside case 29 and outside insulator 30 and anode 10. Although member 25 may be adjacent insulator 30 near grounded cathode 20; the remainder of case 29 must be spaced from insulator 30 and anode 10 to prevent discharge.

'Tubular' in the context of this invention means the hollow structure that is defined as a profile of the insulator wall is moved in a continuous closed path around axis 8. If the profile is a straight rectangle set at an angle to axis 8, and the closed path is a circle centered on axis 8 (as viewed along axis 8), the resulting structure is the hollow truncated cone 30 shown in FIG. 1. If the profile is curved in the manner of member 25 in FIG. 1, the resulting tubular structure has curved sides. Alternatively, if the path about axis 8 were elliptical, the tubular cone would then be elliptical. Most switch applications in accordance with this invention will have insulator shapes derived from the aforementioned circle.

Each electrode has a surface interior (with respect enclosure 80) facing and spaced from the interior surface of the other electrode along common axis 8. Cathode 20 is sealed to an adjacent edge 32 of dielectric 30, and anode 10 is sealed to an adjacent edge 34 of dielectric 30, thereby containing volume 80 which is evacuated by conventional means such as a sealable orifice (not shown) in cathode 20 connected to a vacuum pump (not shown) in a manner well known in the art.

In accordance with this invention, a controllable electron generator 50 is provided adjacent cathode 20 to initiate breakdown, as discussed hereinafter.

The electrodes should be formed of materials such as steel having a high melting temperature to withstand the electric arc resulting from operation of the switch. At least the interior surface of anode 10 should be a material having a high atomic number to maximize the probability that secondary and reflected electrons will be released, as discussed hereinafter. In the disclosed embodiment, anode 10 is formed of a high Z (atomic number) refractory metal such as tungsten, molybdenum, tantalum, niobium, chromium, rhenium or alloys thereof. Alternatively, a layer of such material could be coated or attached on the interior surface of anode 10.

Insulator 30 must be capable of being vacuum sealed to the electrodes and, preferably, is a material with a high melting temperature and good resistance to the operating environment of a discharge switch. (The IEEE article by T. Engle et al, cited above, provides a good discussion of this subject.) Alumina ceramic is an example of a suitable insulator for this application.

The principle of operation for this invention is as follows:

In the open circuited condition, device 5 has a high positive voltage (typically on the order of 100KV) applied to anode 10 and cathode 20 is grounded. No conduction is occurring across device 5.

Electron generator 50 injects electrons 55 into volume 80 to start the discharge process. The negatively-charged electrons 55 are attracted by the high positive voltage on anode 10, where many electrons are directed from the anode surface as energetic secondary or reflected electrons 57 to the adjacent interior wall of insulator 30 at end 32.

Because of the high electric fields at the anode and the energetic electrons, an electron avalanche 59 is initiated near anode 10 along the interior surface of insulator 30, as discussed at pages 5 and 10 of the aforementioned *Review of Surface Flashover Theory*. The fields increase at the head of this avalanche and cause avalanche 59 to continuously grow along the interior surface of insulator 30 toward cathode 20 as shown in FIG. 1, thereby completing a conductive path between anode and cathode, and closing switch 5.

An important factor in this invention is that the electrons 55 which initiate the process flow across the switch gap approximately 100 times faster than ions would flow. Accordingly, the switch of the invention actuates more quickly than a prior art gas or plasma switch that relies on ion conduction to initiate breakdown.

Another important factor is that avalanche conduction from anode 10 to cathode 20 causes substantially less arc damage to insulator 30 than does an equivalent breakdown from cathode to anode. As shown by the references, the anode to cathode breakdown 59 branches into an ever-widening pattern as it moves, while a more conventional cathode to anode pattern follows a relatively straight, thin line, which concentrates the energy along a smaller footprint.

Although any electron generator 50 conceivably could be used to initiate breakdown as described, the desirable properties of such a source include simplicity and electrical isolation from the high voltage. As shown in FIG. 1, electron source 50 is a spark gap that is easily formed by the end 54 of a single electrical conductor 52 extending through grounded cathode 20. The spark gap can be formed like an automotive spark plug, where conductor 52 is spaced from a metallic housing 56 by a ceramic insulator 58. Housing 56 is brazed, welded, or otherwise fastened into a hole in cathode 20 in a manner which will form a vacuum seal. End 54 of conductor 52 is preferably flush with, or recessed from, the interior surface of cathode 20, in order that end 54 does not appear as a imperfection in cathode 20 that could cause an uncontrolled one-step discharge of switch 5. End 54 is also preferably placed away from insulator 30 at or near the center of cathode 20. A sufficient positive or negative voltage from supply 65 to cause a spark between end 54 and housing 56 may be connected to conductor 52 through a switch 60. When switch 60 is momentarily closed, the resulting spark generates electrons that are attracted by the high positive voltage 18 applied to anode 10. The spark gap discharges randomly from end 54 to housing 56, which causes the electrons 55 to strike at random locations around anode 10. If the electrons strike anode 10 repeatedly at one spot, that spot will generate repeat flashovers which reduce the shot life of the switch.

Other equivalent structures, such as an electrical feedthrough for an electrical conductor, may also be used to provide a spark within volume 80 adjacent cathode 20. Alternatively, electron generator 50 could be a voltage gated point field emitter, thermionic emitter, beta emitter, or other electron generator.

Switch 5 is shaped to minimize the undesirable spontaneous one-step electron avalanche from cathode to anode, and to enhance the desirable controlled anode to cathode mini-electron avalanche discharge described above. A one-step avalanche is most likely to occur when the electrostatic field lines resulting from the voltage gradient between anode 10 and cathode 20 are parallel to the surface of insulator 30, as such configuration provides the lowest barrier for an electron to be extracted from an insulator. For example, it is widely known that an insulator that forms a right cylinder between large, parallel, spaced electrodes has field lines that are parallel to the insulator surface and has the greatest tendency for a one-step cathode-to-anode avalanche. For this reason, voltage standoff devices are frequently designed with a truncated conical insulator and a smaller anode than cathode, as shown in FIG. 1. For a conical insulator, the diameter at anode 20 is typically about 50% of the diameter at cathode 10. However, as discussed hereinafter, any electrode and insulator design also is a function of the shape of conducting case 29.

The optimal design of switch 5 has electric fields that are low at the cathode (to minimize one-step breakdown) and high at the anode (to maximize anode-cathode breakdown when energetic electrons strike insulator 30, as discussed above). Having a smaller anode than cathode keeps the fields at the anode greater than at the cathode. The convex interior surface of anode 10 also helps to increase the electric fields near end 34 of insulator 30. In a similar manner, the concave interior surface of cathode 20 helps to decrease electric fields near end 32 of insulator 30.

Figure 2:
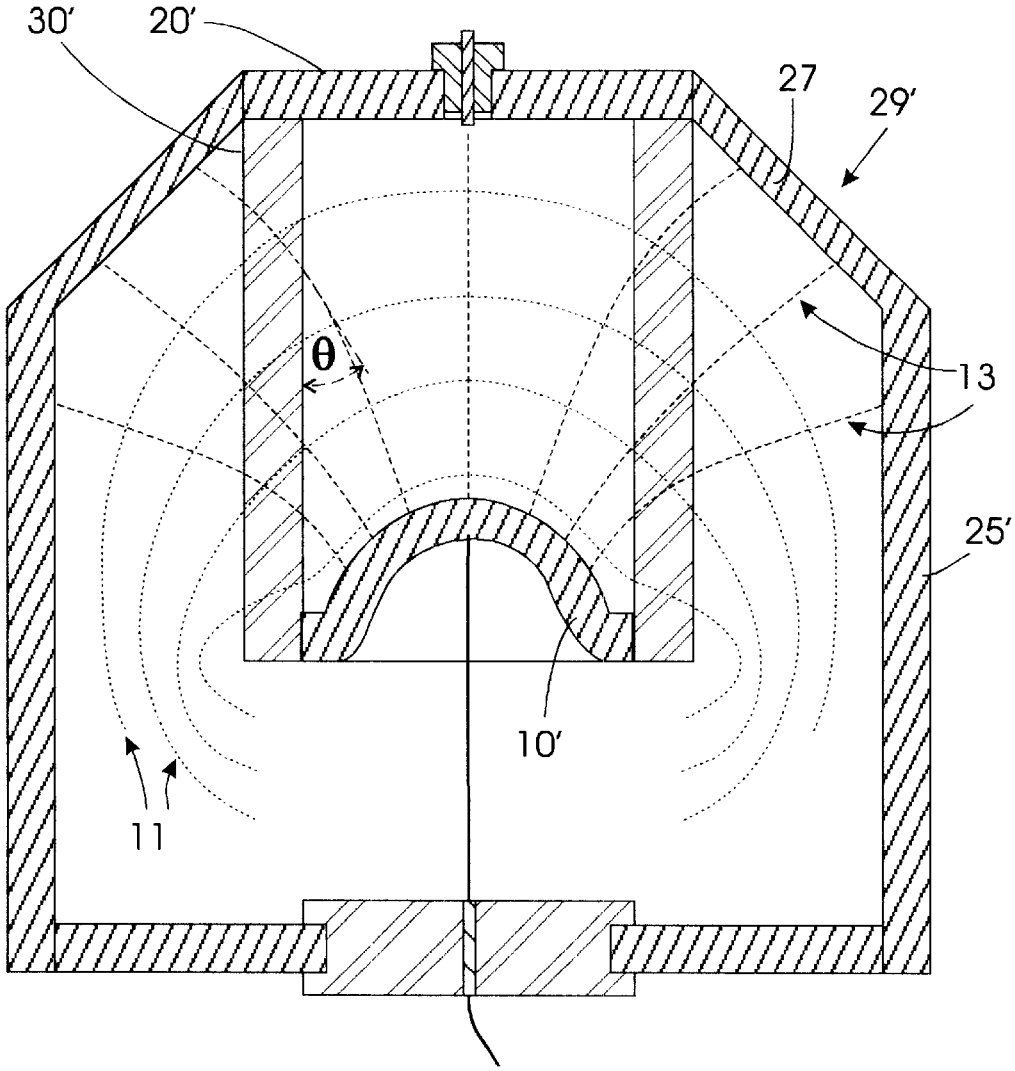
FIG. 2 shows an alternate embodiment of the invention.

As shown in FIG. 2, the electric field is most easily represented by first drawing the equipotential lines 11 which surround charged anode 10, and then drawing electric field lines 13 from anode 10 to the cathode 20 (or case 29), subject to the constraint that electric field lines 13 are perpendicular to each of anode 10, cathode 20, and equipotential lines 11. In addition, the angle θ at which electric field lines intersect insulator 30 should be on the order of 30 to 60°, to minimize one step breakdown as discussed at page 7 of the aforementioned *Review of Surface Flashover Theory*. (For the undesirable right cylinder discussed above, the electric field lines are parallel to the insulator and either do not intersect it, or intersect it at very small angles.) The curved profile for case 29 of the embodiment of FIG. 1 helps to provide the proper field angles for that embodiment.

FIG. 2 shows an alternative embodiment of the invention to include a flat cathode 20' spaced from a domed anode 10' by a right cylindrical insulator 30'. This insulator configuration, previously described as undesirable, meets the criteria for this invention because of tubular case 29', which includes a tapered portion 27 extending from cathode 20' and a straight cylindrical portion 25'. Tapered portion 27 causes equipotential lines 11 to curve around anode 10', and the resulting electric field lines 13 therefore intersect insulator 30' at a desired angle θ. It should be apparent that if portion 27 did not taper but followed the plane of cathode 20', then equipotential lines 11 would not curve as much, and the angle θ would be much smaller.

An idealized version of the embodiment of FIG. 2, from the standpoint of high anode fields and low cathode fields, would be a point source anode at the center of a conductive sphere. However, the lifetime of such a switch would be very limited because of the effect of the arc on the small area of such an anode.

Figure 3:
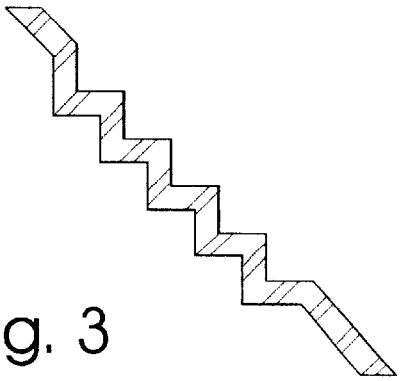
FIG. 3 shows an undesirable construction of a portion of a switch as taught by the invention.

Many other configurations can achieve the desirable angles. For example, case 29' in FIG. 2 can have a rounded profile, rather than one formed of 3 straight portions. Also, the profile of insulator 30 may be curved similar to the profile of case 29 in FIG. 1. Many other arrangements will be apparent to those skilled in the art. However, the slope (first derivative) of the profile of the interior of the insulator should be continuous and not have sudden angular changes as illustrated in FIG. 3, as these discontinuities will impede the desirable anode-to-cathode breakdown.

If the polarity of the devices of FIG. 1 or 2 were reversed, and electron generator 50 was placed at the smaller electrode (i.e., the new cathode), the high electric field at the new cathode would reduce the high voltage holdoff capacity of the switch. In this undesirable case, electrons field-emitted from the new cathode would be directed into the insulator at the new anode, thereby charging the insulator and creating fields more parallel to the insulator that would cause a one-step electron avalanche to occur that would spontaneously initiate the switch. Furthermore, the electrons on the insulator will be trapped on the insulator surface, thereby impeding the desired avalanche.

The typical prior art high voltage tube or switch is designed to minimize the possibility of reflection of electrons from anode 10 to insulator 30. For this invention, the reflection of electrons and generation of secondary electrons is necessary for the operation of the switch. While anode 10 may just be a flat disk, it preferably includes a raised portion 19 having a dome or cone shape as shown in FIG. 1. The resulting convex interior surface of anode 10 increases the probability of secondary electrons 57 reaching insulator 30. The interior surface of raised portion 19 should be formed of the high Z metals discussed above; the remainder of anode 10 may be formed either of high Z or other metal.

A device for switching about 100K volts according to this invention could have an anode and cathode formed of tungsten and an alumina insulator. Vacuum sealing the tungsten—alumina interface is well known in the art. A device having a distance between electrodes of about one inch, a cathode diameter of about one and one half inches at the exterior of the insulator, and an anode diameter of about one half inch, evacuated to at least $10^{-8}$ torr, would reliably hold off 100K volts, and switch in 10 ns when a 500 volt or greater supply 65 is momentarily connected to electrode 52, creating a spark at end 54.

The particular sizes and equipment discussed above are cited merely to illustrate a particular embodiment of this invention. Many variations of the structure of the invention are possible, such as using elliptical or other cross-sections for the tubular anode, insulator, cathode and case.

Furthermore, while it is preferable that these elements be aligned along axis 8, such alignment is not necessary, so long as the resulting structure provides for anode to cathode breakdown in response to electron generation from the cathode, as discussed above. It is intended that the scope of the invention be defined by the claims appended hereto.

What is claimed is:

1. A high voltage switch comprising:

an electrically conductive cathode having inner and outer spaced surfaces;

an electrically conductive anode having inner and outer spaced surfaces, said inner surface of said anode facing said inner surface of said cathode, said anode having applied thereto a high positive voltage relative to said cathode;

a hollow tubular insulator sealed at one end to said anode and at an opposite end to said cathode to define a volume that is evacuated; and a controllable generator of electrons within the volume adjacent said cathode; wherein generated electrons cause an anode initiated breakdown to change said switch from a non-conducting to a conducting state.

2. The high voltage switch of claim 1 wherein said insulator is circular.

3. The high voltage switch of claim 2 wherein each of said cathode and anode are circular.

4. The high voltage switch of claim 1 wherein electric fields extend between said anode and said cathode when the high positive voltage is applied to said anode, the electric field at said anode being greater than the electric field at said cathode.

5. The high voltage switch of claim 4 wherein the circumference of said insulator at said anode is smaller than the circumference of said insulator at said cathode.

6. The high voltage switch of claim 5 wherein the circumference of said insulator at said anode is less than 50% of the circumference of said insulator at said cathode.

7. The high voltage switch of claim 4 wherein the inner surface of said anode is convex.

8. The high voltage switch of claim 7 wherein said inner surface of said anode is formed of a high Z metal.

9. The high voltage switch of claim 3 further comprising:

an electrically conductive case comprising:

a tubular portion surrounding said insulator, said portion having one end extending from said cathode and a base extending across an opposite end, said base being spaced from said anode; and an insulator extending through said base; and an electrical conductor extending from said anode through said insulator, wherein said conductor and said grounded case consist of two terminals of said switch.

10. The high voltage switch of claim 9 wherein the circumference of said insulator at said anode is smaller than the circumference of said insulator at said cathode, and the circumference of said tubular portion of said case at said cathode is larger than the circumference of said tubular portion at said opposite end.

11. The high voltage switch of claim 10 wherein said base is a metal disk sealing said opposite end, and said insulator comprises a disk of insulating material smaller than and centered in said metal disk.

12. The high voltage switch of claim 10 wherein said tubular portion of said case has a curved profile.

13. The high voltage switch of claim 3 wherein said generator of electrons is spaced from said insulator on said cathode.

14. The high voltage switch of claim 13 wherein said generator of electrons is centered on said axis.

15. The high voltage switch of claim 14 wherein said generator of electrons comprises an electrical conductor surrounded by an electrical insulator, one end of said conductor extending outside said switch, an opposite end of said conductor extending no further into said switch than the inner surface of said cathode, said opposite end being spaced from said cathode by said insulator.

16. The high voltage switch of claim 15 wherein said one end of said electrical conductor is connected to a controllable generator of a pulse of sufficient voltage to cause a spark between said opposite end of said conductor and said cathode.

17. The high voltage switch of claim 15 wherein said generator of electrons further comprises a metal housing surrounding said electrical insulator, wherein said metal housing is in a hole extending through said cathode.

18. The high voltage switch of claim 17 wherein said metal housing extends to the inner surface of said cathode, said insulator does not extend to the inner surface of said cathode, and said electrical conductor extends to a location between the end of said housing and the end of said insulator.

19. The high voltage switch of claim 17 wherein said electrical conductor is along said axis.

20. The high voltage switch of claim 19 wherein said generator of electrons is symmetrical about said axis.

21. The high voltage switch of claim 9 wherein said tubular portion of said case comprises a tapered portion extending from said cathode to a cylindrical portion, said cylindrical portion extending to said base, the circumference of said tapered portion at said cathode being less than the circumference at said cylindrical portion.

22. The high voltage switch of claim 21 wherein said insulator is cylindrical.

23. The high voltage switch of claim 22 wherein most of the electric field lines extending between said anode and said cathode pass through said insulator at an angle between 30° and 60°.

24. The high voltage switch of claim 9 wherein most of the electric field lines extending between said anode and said cathode pass through said insulator at an angle between 30° and 60°.

* * * * *